United States Patent [19]

Simon, deceased et al.

[11] Patent Number: 4,596,515

[45] Date of Patent: Jun. 24, 1986

[54] OIL WELL PUMP

[75] Inventors: Donald J. Simon, deceased, late of Midland, by Betty O. Simon, executrix; Leeroy R. Williams, Graham, both of Tex.

[73] Assignee: Sargent Industries, Inc., Los Angeles, Calif.

[21] Appl. No.: 530,352

[22] Filed: Sep. 8, 1983 (Under 37 CFR 1.47)

[51] Int. Cl.[4] ..... F04B 3/00; F04B 21/04

[52] U.S. Cl. ..... 417/53; 417/259; 417/552

[58] Field of Search ..... 417/259, 260, 545, 547, 417/552, 554, 527, 53

[56] References Cited

U.S. PATENT DOCUMENTS

| | | | |
|---|---|---|---|
| 1,066,798 | 8/1913 | Conrader | 417/259 |
| 1,697,007 | 12/1928 | Lewis et al. | 417/259 |
| 2,193,020 | 3/1940 | Collins | 417/495 |
| 2,723,625 | 11/1955 | Nichols | 417/259 |
| 3,074,382 | 1/1963 | Vincent | 417/259 |
| 3,136,265 | 6/1964 | Chenault | 417/554 |
| 3,140,667 | 7/1964 | Anderson et al. | 417/547 |
| 3,143,080 | 4/1964 | Sutliff | 417/554 |
| 3,175,512 | 3/1965 | Sutliff | 417/547 |
| 4,219,311 | 8/1980 | Simon | 417/454 |
| 4,243,361 | 1/1981 | Groff | 417/554 |

*Primary Examiner*—William L. Freeh

*Attorney, Agent, or Firm*—Ellsworth R. Roston; Charles H. Schwartz

[57] ABSTRACT

A pump recovers viscous fluid from a well area defined by a casing extending downwardly into the well. The pump includes a stationary sleeve disposed within the casing and a tubing disposed within the sleeve and reciprocatable upwardly and downwardly within the sleeve and defining a first closure within the sleeve near its bottom end. A first member is disposed on the tubing in slidable relationship to the tubing and a second member is disposed within the sleeve in co-operative relationship with the first member to define a first valve having open and closed positions. The first and second members are disposed above the first closure to define a pump chamber with the first closure. The tubing is spaced from the sleeve above the first valve to define a storage chamber with the first valve. Means define a second valve with the sleeve at a position below the first valve and have open and closed positions. Such means are responsive to the downward movement of the tubing to become opened for providing for a flow of fluid into the pump chamber through the second valve from a position below the second valve. At least one port may be provided in the tubing at a position co-operative with the first member for defining with the first member a third valve having open and closed positions. The third valve may be operable in the open position near the end of the downward movement of the tubing to provide for the passage of fluid from the storage chamber into the pump chamber near the end of such downward movement of the tubing. This prevents fluid pound in the upward movement of the tubing. Means may also be included in the pump for draining fluid from the storage chamber and the pump chamber during the downward movement of the tubing.

38 Claims, 4 Drawing Figures

OIL WELL PUMP

This invention relates to oil well pumps and more particularly relates to pumps for recovering viscous oil from beneath the surface of the earth. The invention also relates to pumps for recovering such viscous oil without fluid knock and for flushing the oil from the pump to wash away sand accumulated in the pump.

Most of the non-viscous oil beneath the earth's surface may have now been discovered and much of such oil may have now been pumped and used. However, the need for oil has continued. If anything, the need for oil may actually be increasing even though attempts are being made to increase the efficiency with which such oil is being used.

As the hunt for locating oil beneath the earth's surface continues, increased attention is being provided to locating and pumping viscous oil. Increasing amounts of such viscous oil are now being pumped. However, the pumping of such viscous oil has created problems. For example, because the oil is viscous, it has had to be pumped at low rates. Furthermore, the pumping equipment has not been able to operate for extended periods of time without repair. Such low pumping rates and required repairs have caused the recovery of viscous oil to be costly and inefficient.

Considerable efforts have been made to increase the efficiency and longevity of pumps which are used to recover viscous oil from beneath the earth's surface. In spite of such extensive efforts, relatively little progress has been made in providing a satisfactory pump. Such progress has been slow and unsatisfactory in spite of the fact that such efforts have continued over a considerable number of years.

This invention provides a pump which overcomes the above disadvantages. The pump is able to recover viscous oil at a considerably increased rate from beneath the earth's surfaces in comparison to the pumps of the prior art. The pump is further able to avoid fluid pound in the pump even when the conditions exist in a well for fluid pound with the pumps of the prior art. The pump is further able to provide for a drainage of fluid from the pump and for a cleansing of sand from the pump by such drainage when an excessive amount of sand has accumulated in the pump. The pump is able to accomplish these results with a construction which is relatively simple and which provides a reliable operation.

The pump of this invention is constructed to recover viscous fluid from a well area defined by a casing extending downwardly into the well. The pump includes a stationary sleeve disposed within the casing and a tubing disposed within the sleeve and reciprocatable upwardly and downwardly within the sleeve and defining a first closure within the sleeve near its bottom end.

A first member is disposed on the tubing in slidable relationship to the tubing and a second member is disposed within the sleeve in co-operative relationship with the first member to define a first valve having open and closed positions. The first and second members are disposed above the first closure to define a pump chamber with the first closure. The tubing is spaced from the sleeve above the first valve to define a storage chamber with the first valve.

Means define a second valve with the sleeve at a position below the first valve and have open and closed positions. Such means are responsive to the downward movement of the tubing to become opened for providing for a flow of fluid into the pump chamber through the second valve from a position below the second valve.

At least one port may be provided in the tubing at a position co-operative with the first member for defining with the first member a third valve having open and closed positions. The third valve may be operable in the open position near the end of the downward movement of the tubing to provide for the passage of fluid from the storage chamber into the pump chamber near the end of such downward movement of the tubing. This prevents fluid pound in the upward movement of the tubing. Means may also be included in the pump for draining fluid from the storage chamber and the pump chamber during the downward movement of the tubing.

Figure 3:
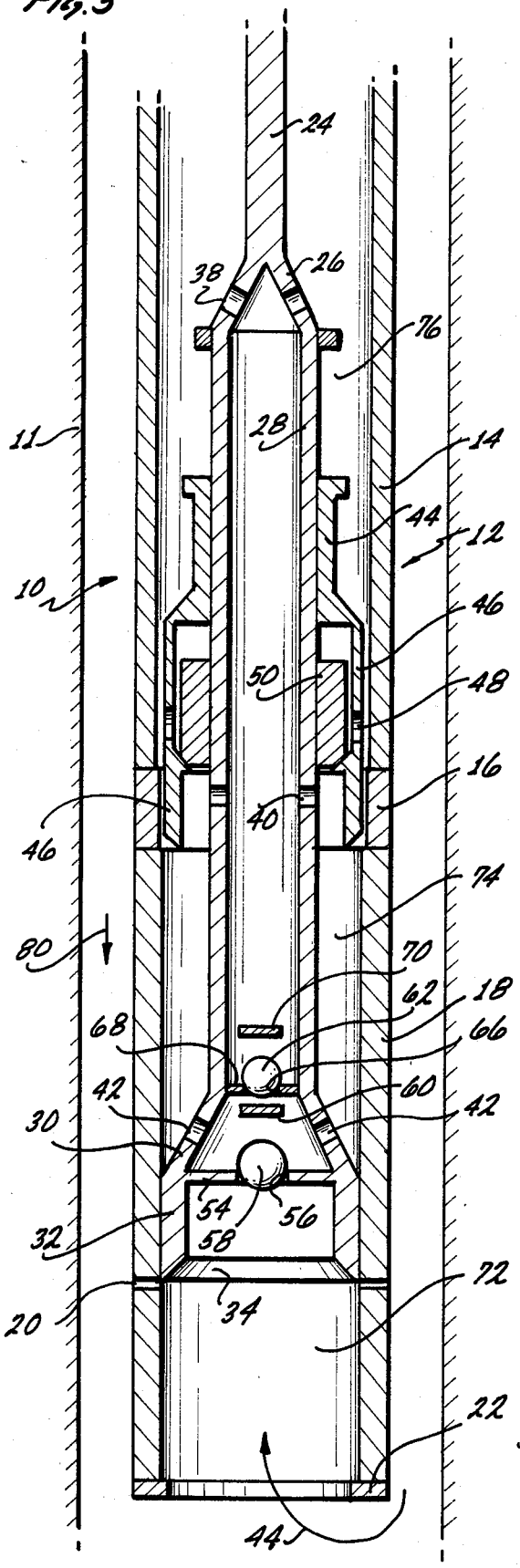
Figure 4:
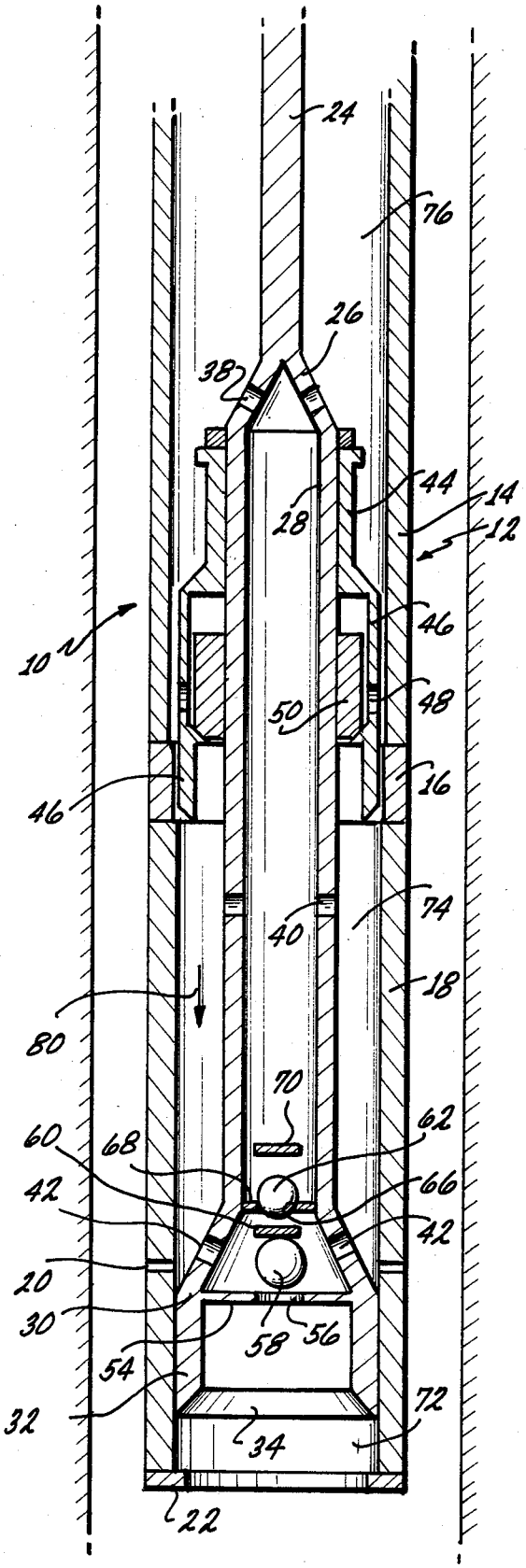

FIG. 3 is a sectional view of the pump near the end of the downstroke of the sucker rod when the movable elements in the pump have been adjusted in position to prevent fluid pound in the well; and FIG. 4 is a sectional view of the pump near the end of the downstroke of the sucker rod when the movable elements in the pump have been adjusted in position to provide for a drainage of fluid from the pump and the cleansing of sand from the pump.

In one embodiment of the invention, a pump generally indicated at 10 is adapted to be disposed within a casing 11. The pump 10 includes a sleeve, generally indicated at 12, which may be formed by a cylindrical member 14, a nipple 16 and a barrel 18. Ports 20 may be provided in the barrel 18 near the bottom of the barrel. An inwardly turned flange 22 may be provided on the barrel 18 at the bottom of the barrel.

A sucker rod 24 is reciprocatable upwardly and downwardly within the sleeve 12. The sucker rod is bifurcated as at 26 to define a tubing 28 which is spaced from the sleeve 12. At a position near its bottom end, the tubing 28 flares outwardly as at 30 to define a plunger 32 which has a diameter slightly less than the inner diameter of the barrel 18. The bottom surface of the plunger 28 is bevelled as at 34 to define pointed scoops for cutting into the viscous oil disposed below the plunger when the sucker rod is moved downwardly relative to the sleeve 12.

Ports 38 are provided in the bifurcation 26 of the sucker rod 24 and ports 40 are provided in the tubing 28 at an intermediate position along the axial length of the tubing. Ports 42 are disposed in the flared portion 30 of the sucker rod 24. A guide member 44 is disposed on the tubing 28 and is provided at its bottom end with a neck portion 46 which is disposed in spaced relationship to the tubing. Ports 48 are provided in the neck portion 46 of the guide member 44. A collar 50 is slidably disposed on the tubing 28 and is shaped relative to the neck portion 46 to slide within the neck portion. The collar 50 is shaped relative to the valve element 48 to define a valve having open and closed positions. For example, the facing surfaces of the valve element 48 and the collar 50 may be provided with compatably inclined surfaces.

A substantially horizontal platform 54 is integral with the upper end of the plunger 32 and has a port 56 for receiving a ball 58. The ball 58 and the port 56 define a valve. The displacement of the ball 58 from the port 56 is limited by a control plate 60. In like manner, a ball 62 is adapted to be disposed in a port 66 of a crosspiece 68 to define a valve. The displacement of the ball 62 from the port 66 is limited by a control plate 70.

The viscous fluid in the casing 10 seeps into the space or reservoir 72 within the barrel 18. The level of this fluid within the barrel 18 is dependent upon several factors. These include the viscosity of the fluid and the friction of the fluid against various surfaces including the surfaces of the barrel 18. It is also dependent upon the force of gravity and the pressure difference of the fluid within the barrel 18 relative to the pressure of the fluid between the barrel 18 and the plunger 32.

The sucker rod 24 is moved downwardly to lift the fluid into a pump chamber 74 from the space or reservoir 72 in the barrel 18 below the valve including the ball 58. The bottom of the pump chamber 74 is defined by a closure produced between the plunger 32 and the barrel 18. The top of the pump chamber is defined by the valve which is formed by the collar 50 and the neck portion 46 of the guide member 44. It is also defined by the valve which is formed by the collar 68 and the ball 62.

When the sucker rod 24 is moved downwardly by gravity, a downward force of gravity is produced on the plunger 32. A downward force is also produced on the plunger 32 by the pressure of the fluid on the surface of the bifurcated portion 26. This downward force causes the plunger 32 to move downwardly into the fluid in the space 72. The movement of the plunger into the fluid is facilitated by the scoop action produced by the bottom surface 34 of the plunger.

During the time that the plunger 32 is moving downwardly, the fluid acts against the ball 58 to open the valve which includes the ball. Fluid is accordingly able to flow through this valve and the ports 42 into the valve chamber 74. During this time, the valve including the ball 62 is closed. The valve defined by the collar 50 and the neck portion 46 is also closed at this time. This prevents fluid from flowing from the pump chamber 74 into a storage chamber 76 above the valve defined by the collar 50 and the neck portion 46.

Figure 2:
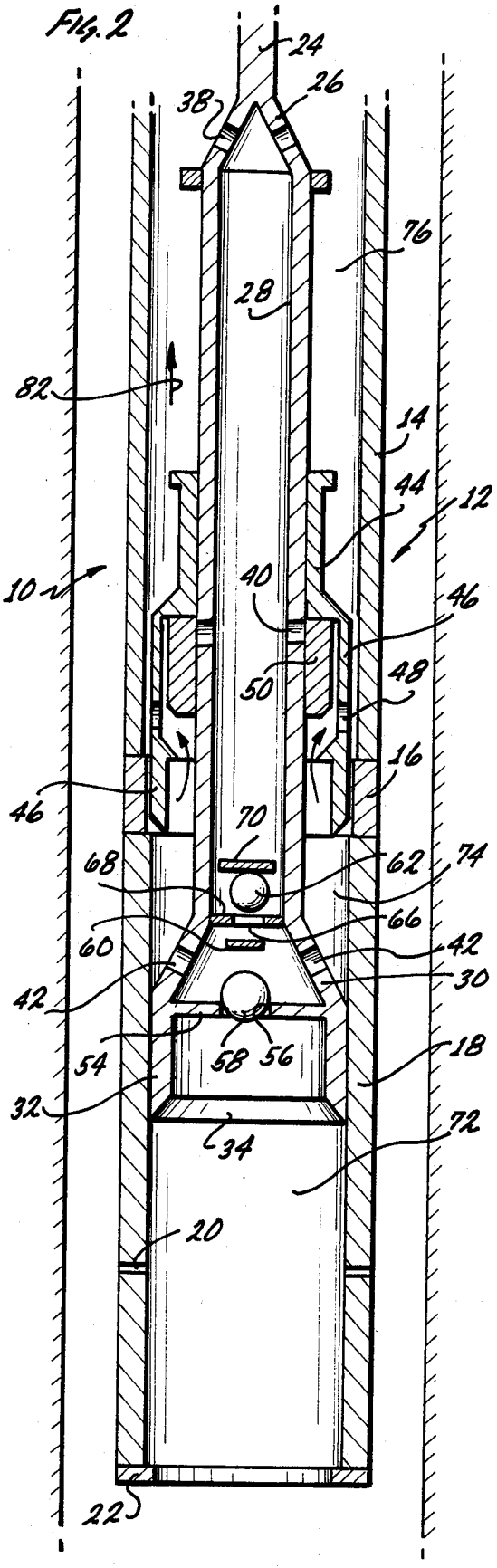
FIG. 2 is a sectional view of the pump and illustrates the relative positions of the pump during the upstroke of the sucker rod.

When the sucker rod 24 moves upwardly as shown by an arrow 82 in FIG. 2, the valve including the ball 58 becomes closed. At the same time, fluid in the pump chamber 74 flows through the ports 42 into the space within the tubing 28 and moves the ball 62 from the port 66. This movement of the fluid is facilitated by the fact that the volume of the pump chamber 74 is being contracted as the sucker rod 24 is moved upwardly. The contraction of the pump chamber 74 causes a force to be exerted upwardly against the collar 50. This causes the collar 50 to become displaced upwardly from the valve element 48 so that the valve defined by the collar and the neck portion 46 becomes opened. Fluid then flows from the pump chamber 74 through this valve into the storage chamber 76. Fluid also flows into the storage chamber 76 through a path including the ports 42, the valve including the ball 62 and the ports 38. The fluid in the storage chamber 76 is then lifted to the surface of the earth.

During the time that the sucker rod 24 is moving upwardly, fluid is flowing into the space or reservoir 72 to replenish the fluid previously withdrawn from this space during the downward movement of the sucker rod. Furthermore, during the upward movement of the sucker rod, fluid is producing a force on the flared portion 30 of the tubing 28. Since this force is greater than the force produced by the fluid on the bifurated portion 26 of the tubing 28 during the downward movement of the sucker rod 24, a potential force representing the difference between the forces produced by the fluid on the tubing 28 during the upward and downward movements of the tubing is available as potential energy to the tubing. This potential energy is converted into actual energy by the plunger 32 on the fluid during the downward movement of the tubing and the plunger. This enhances the ability of the pump to raise the fluid from the reservoir 72 into the pump chamber 74 during the downstroke of the sucker rod 24.

The pump described above has certain important advantages. It provides for an efficient transfer of viscous fluid from the reservoir 72 initially into the pump chamber 74 and then into the storage chamber 76. For example, pumps having this invention have operated in wells containing viscous fluid to lift such fluid from the reservoir 72 into the pump chamber 76 at a rate of several cycles per minute. This is in contrast to the pumps of the prior art. Such pumps have been able to operate in the same wells at a rate of only about one (1) cycle per minute. Applicant's pump accordingly has provided a significantly enhanced efficiency in recovering viscous fluid from wells relative to the pumps of the prior art.

It may sometimes happen that the well has somewhat depleted characteristics so that an incomplete amount of fluid is transferred into the pump chamber 74 during the downstroke of the sucker rod 24 and the tubing 28. When this occurs, the sucker rod 24 and the tubing 28 may be subjected to fluid pound as they are moved upwardly. This results from the fact that the pressure of the fluid increases as the sucker rod 24 and the tubing 28 move upwardly to contract the volume of the pump chamber 74. When the pressure of this fluid increases to a particular value, the fluid imposes upon the tubing 28 a force which initiates a shock load and vibrations in the tubing. The shock load and vibrations imposed upon the tubing 28 limit the life of the pumps subjected to such shock load and vibrations.

Figure 1:
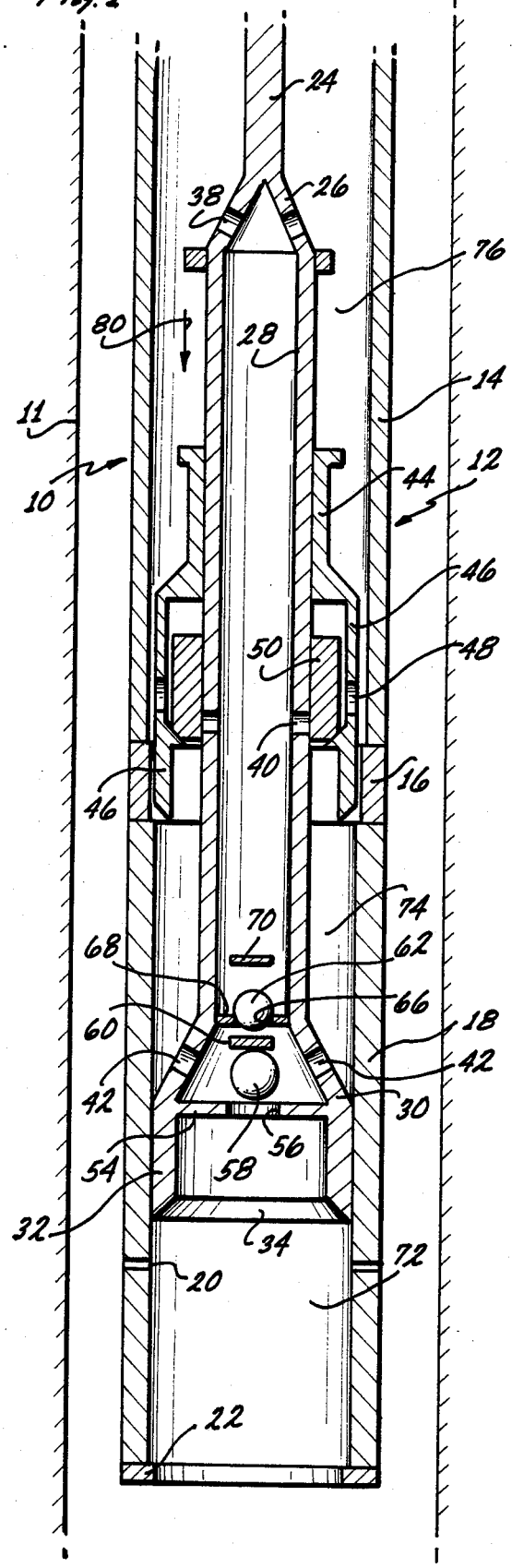
FIG. 1 is a sectional view of a pump constituting one embodiment of this invention and illustrates the relative positions of the various parts of the pump when the sucker rod and the elements moving with the rod are near the end of the downstroke in their reciprocal movement in the well.

The pump of this invention utilizes the principles of the "Pump Assembly" disclosed and claimed in U.S. Pat. No. 4,219,311 (issued on Aug. 26, 1980, to Donald J. Simon and assigned of record to the assignee of record in this application) to avoid fluid pound. In order to avoid fluid pound, the sucker rod 24 and the tubing 28 are displaced downwardly somewhat in the sleeve 12 from the positions shown in FIGS. 1 and 2. In the positions shown in FIGS. 1 and 2, the valve formed by the port 40 and the slide 50 is closed at all times during the upstroke and downstroke of the sucker rod 24 and the tubing 28.

To avoid fluid pound, the sucker rod 24 and the tubing 28 are displaced downwardly in the sleeve 12 so that the port 40 becomes exposed near the end of the downstroke of the sucker rod and the tubing as shown in FIG. 3. This causes the valve defined by the port 40 and the collar 50 to become exposed near the end of the downstroke of the sucker rod 24 so that fluid is able to flow from the storage chamber 76 through the port 38 and the port 40 into the pump chamber 74. This causes the pressure of the fluid in the pump chamber 74 at the beginning of the upstroke of the sucker rod 24 and the tubing 28 to be increased above the value of the fluid pressure which would otherwise be produced. This increase in fluid pressure in the pump chamber 74 at the beginning of the upstroke of the sucker rod 24 prevents any fluid pound from being produced on the tubing 28 during the upstroke of the tubing.

It may sometimes happen that the pump of this invention may be operating with particles of sand which has sifted into the pump from the well. These particles of sand tend to limit the life of the pump unless they can be removed from the pump. In order to remove the particles of sand from the pump, the pump is drained of fluid. Hopefully, the particles of sand will drain with the fluid from the pump so that the pump will then be in condition to resume an effective operation.

To drain the fluid from the pump, the sucker rod 24 and the tubing 28 are displaced downwardly in the sleeve 12 to a position where its downstroke is limited by the flange 22 on the barrel 18. This is shown in FIG. 4. As the plunger 32 moves downwardly toward the flange 22, it exposes the ports 20 so that the valves defined by the ports and the plunger become open. Fluid then flows from the storage chamber 76 through the ports 38, the ports 40 and the ports 20 into space between the barrel 18 and the casing 11. The fluid in the pump chamber 74 also flows into the space between the barrel 18 and the casing 11. The fluid flowing into the casing 11 carries into space between the barrel 18 and this space the particles of sand in the pump.

Although this application has been disclosed and illustrated with reference to particular applications, the principles involved are susceptible of numerous other applications which will be apparent to persons skilled in the art. The invention is, therefore, to be limited only as indicated by the scope of the appended claims.

What is claimed is:

1. In combination for pumping viscous fluid from a well, a sleeve, a tubing disposed within the sleeve, means including the sleeve and the tubing for defining a pump chamber, first means, including the tubing, reciprocatable upwardly and downwardly within the sleeve for providing for an enlargement of the pump chamber during the downward movement of the tubing and for providing for a contraction of the pump chamber during the upward movement of the tubing, second means including a first valve for providing for the introduction of fluid from the well into the pump chamber during the downward reciprocatory movement of the tubing, third means associated with the sleeve and the tubing to define a second valve and a storage chamber above the second valve and responsive to the upward reciprocatory movement of the tubing to provide for an opening of the second valve for a flow of fluid from the pump chamber into the storage chamber within the sleeve at a position above the second valve, means included in the tubing and associated with the third means to define a third valve operable near the end of the downward movement of the tubing to provide for the introduction of fluid into the pump chamber from the storage chamber near the end of the downward movement of the tubing to prevent fluid poundage in the pump chamber at the beginning of the upward movement of the tubing, and fourth means associated with the tubing to define a fourth valve for preventing fluid from flowing from the well into the storage chamber during the downward movement of the tubing and for providing for a flow of fluid from the pump chamber into the storage chamber during the upward movement of the tubing.

2. The combination set forth in claim 1 wherein the second valve is a dual valve providng for the flow of viscous fluid into the storage chamber from the pump chamber both internally and externally of the tubing during the upward reciprocatory movement of the tubing.

3. The combination set forth in claim 1 wherein the tubing is hollow and wherein means are associated with the tubing for preventing fluid from flowing into the tubing during the downward movement of the tubing.

4. The combination set forth in claim 2, including, the tubing being constructed at its bottom end to define a scoop for facilitating the movement of the fluid into the pump chamber from a position below the first valve during the downward movement of the tubing.

5. A combination as set forth in claim 1, including, a port in the tubing at a position above the second and third valves to facilitate the flow of fluid between the pump chamber and the storage chamber.

6. In combination for pumping viscous fluid from a well, a sleeve, a tubing disposed within the sleeve, means including the sleeve and the tubing for defining a pump chamber, first means, including the tubing, reciprocatable upwardly and downwardly within the sleeve for providing for an enlargement of the pump chamber during the downward movement of the tubing and for providing for a contraction of the pump chamber during the upward movement of the tubing, second means including a first valve for providing for the instroduction of fluid from the well into the pump chamber during the downward reciprocatory movement of the tubing, third means associated with the sleeve and the tubing to define a second valve and a storage chamber above the second valve and responsive to the upward reciprocatory movement of the tubing to provide for an opening of the second valve for a flow of fluid from the pump chamber into the storage chamber within the sleeve at a position above the second valve, and means included in the tubing and associated with the third means to define a third valve operable near the end of the downward movement of the tubing to provide for the introduction of fluid into the pump chamber from the storage chamber near the end of the downward movement of the tubing to prevent fluid poundage in the pump chamber at the beginning of the upward movement of the tubing, a port in the sleeve at a position below the bottom position of the tubing in the reciprocatory movement of the tubing, and the tubing being movable relative to the sleeve to a position below the port in the sleeve to provide for a drainage of fluid from the storage chamber through the third valve into the pump chamber in such position of the tubing and a drainage of fluid from the pump chamber through the sleeve into the well in such position of the tubing.

7. The combination set forth in claim 6, including, the tubing being hollow, and means including a port in the tubing and operable during the upward reciprocatory movement of the tubing to provide for a flow of fluid from the pump chamber through the tubing into the storage chamber.

8. The combination set forth in claim 6, including, a port in the tubing for facilitating the flow of fluid into the pump chamber during the downward reciprocatory movement of the tubing and for facilitating the draining of fluid from the storage chamber into the pump chamber and from the pump chamber into the well when the tubing has moved relative to the sleeve to a position below the port in the sleeve.

9. In combination for pumping viscous fluid from a well area defined by a casing extending downwardly into the well, a stationary sleeve disposed within the casing, a tubing disposed within the sleeve and reciprocatable upwardly and downwardly within the sleeve and defining a first closure with the sleeve near its bottom end, first means on the tubing, second means slidable relative to the tubing and associated with the first means for defining a first valve, the tubing, the sleeve, the first valve and the first closure defining a pump chamber expandible during the downward movement of the tubing and contractible during the upward movement of the tubing, means defining a second valve with the tubing, the second valve being disposed relative to the pump chamber and being operable during the downward reciprocatory movement of the tubing to provide for the flow of fluid from the well through the first valve into the pump chamber and being operable during the upward movement of the tubing to inhibit the flow of fluid between the well and the pump chamber, the sleeve and the tubing co-operating with the first valve to define a storage chamber above the first valve, the first valve being operable by the pressure of the fluid within the pump chamber during the upward reciprocatory movement of the tubing to provide for a flow of fluid from the pump chamber into the storage chamber, means disposed in the tubing and associated with the second means for defining a third valve, the third valve being disposed at a position to provide for a passage of fluid from the storage chamber to the pump chamber near the end of the downward reciprocatory movement of the tubing, and means defining a fourth valve with the tubing, the fourth valve being disposed to provide for a flow of fluid from the pump chamber into the storage chamber during the upward movement of the tubing and to prevent a flow of fluid into the storage chamber during the downward movement of the tubing.

10. The combination set forth in claim 9, including means for preventing fluid from flowing between the port chamber and the well during the upward reciprocatory movement of the tubing.

11. The combination set forth in claim 9, including, the first valve being open during the upward reciprocatory movement of the tubing to provide for a flow of fluid from the pump chamber into the storage chamber, and means disposed in the tubing for providing for a flow of fluid from the pump chamber through the tubing into the storage chamber during the opened position of the first valve in the upward movement of the tubing.

12. In combination for pumping viscous fluid from a well area defined by a casing extending downwardly into the well, a stationary sleeve disposed within the casing, a tubing disposed within the sleeve and reciprocatable upwardly and downwardly within the sleeve and defining a first closure with the sleeve near its bottom end, first means on the tubing, second means slidable relative to the tubing and associated with the first means for defining a first valve, the tubing, the sleeve, the first valve and the first closure defining a pump chamber expandible during the downward movement of the tubing and contractible during the upward movement of the tubing, means defining a second valve with the tubing, the second valve being disposed relative to the pump chamber and being operable during the downward reciprocatory movement of the tubing to provide for the flow of fluid from the well through the first valve into the pump chamber and being operable during the upward movement of the tubing to inhibit the flow of fluid between the well and the pump chamber, the sleeve and the tubing co-operating with the first valve to define a storage chamber above the first valve, the first valve being operable by the pressure of the fluid within the pump chamber during the upward reciprocatory movement of the tubing to provide for a flow of fluid from the pump chamber into the storage chamber, and means disposed in the tubing and associated with the second means for defining a third valve, the third valve being disposed at a position to provide for a passage of fluid from the storage chamber to the pump chamber near the end of the downward reciprocatory movement of the tubing, means for preventing fluid from flowing between the port chamber and the well during the upward reciprocatory movement of the tubing, a port in the sleeve at a position below the tubing in the downward reciprocatory movement of the tubing, and the tubing being positionable on the sleeve to define, with the port in the sleeve, a fourth valve preventing fluid from flowing into the well from the pump chamber during the upward and downward reciprocatory movements of the tubing but operable, upon the downward movement of the tubing below the port in the sleeve, to provide for a drainage of fluid from the pump chamber into the well through the fourth valve.

13. In combination for pumping viscous fluid from a well area defined by a casing extending downwardly into the well, a stationary sleeve disposed within the casing, a tubing disposed within the sleeve and reciprocatable upwardly and downwardly within the sleeve and defining a first closure within the sleeve near its bottom end, a first member disposed on the tubing in slidable relationship to the tubing, a second member disposed on the tubing in co-operative relationship with the first member and constructed to define with the first member a first valve having open and closed positions in accordance with the position of the first member relative to the second member, the first and second members being disposed above the first closure to define a pump chamber with the first closure, the tubing extending above the first valve and being spaced from the sleeve in such extension to define a storage chamber with the first valve and the sleeve, means defining a second valve with the tubing at a position below the first valve and having open and closed positions and responsive to the downward reciprocatory movement of the tubing to become opened for providing for a flow of fluid into the pump chamber through the second valve from a position in the well below the second valve, the first valve being constructed and disposed to be closed during the downward reciprocatory movement of the tubing to provide for a flow of the viscous fluid into the pump chamber and a retention of such fluid in the pump chamber and to be opened during the upward reciprocatory movement of the tubing to provide for a flow of the viscous fluid from the pump chamber into the storage chamber, means including the tubing and the first member for defining a third valve, the third valve being constructed and disposed to remain closed during substantially all of the upward and downward reciprocatory movements of the tubing and to become opened near the end of the downward movement of the tubing to provide for a passage of fluid from the storage chamber into the pump chamber for preventing fluid pounding in the upward reciprocatory movement of the tubing, and means including the tubing for defining a fourth valve, the fourth valve being constructed and disposed to become opened during the upward movement of the tubing for facilitating the flow of fluid from the pump chamber into the storage chamber during the upward movement of the tubing and to become closed during the downward movement of the tubing for preventing the flow of fluid into the storage chamber during the downward movemement of the tubing.

14. The combination set forth in claim 13 wherein at least one port is provided in the tubing at a position near the second valve to pass into the pump chamber the fluid flowing through the second valve from the well during the downward reciprocatory movement of the tubing.

15. The combination set forth in claim 14, including, the tubing being hollow, and the fourth valve being disposed above the second valve and having open and closed positions and being operable in the open position during the upward reciprocatory movement of the tubing to provide for a passage of fluid from the pump chamber through the port and through the hollow tubing into the storage chamber.

16. The combination set forth in claim 15, including, at least one port in the tubing at a position above the first valve to facilitate the passage of fluid from the pump chamber through the port into the storage chamber during the upward reciprocatory movement of the tubing.

17. In combination for pumping viscous fluid from a well area defined by a casing extending downwardly into the well, a stationary sleeve disposed within the casing, a tubing disposed within the sleeve and reciprocatable upwardly and downwardly within the sleeve and defining a first closure within the sleeve near its bottom end, a first member disposed on the tubing in slidable relationship to the tubing, a second member disposed on the tubing in co-operative relationship with the first member and constructed to define with the first member a first valve having open and closed positions in accordance with the position of the first member relative to the second member, the first and second members being disposed above the first closure to define a pump chamber with the first closure, the tubing extending above the first valve and being spaced from the sleeve in such extension to define a storage chamber with the first valve and the sleeve, means defining a second valve with the tubing at a position below the first valve and having open and closed positions and responsive to the downward reciprocatory movement of the tubing to become opened for providing for a flow of fluid into the pump chamber through the second valve from a position in the well below the second valve, the first valve being constructed and disposed to be closed during the downward reciprocatory movement of the tubing to provide for a flow of the viscous fluid into the pump chamber and a rentention of such fluid in the pump chamber and to be opened during the upward reciprocatory movement of the tubing to provide for a flow of the viscous fluid from the pump chamber into the storage chamber, means including the tubing and the first member for defining a third valve, the third valve being constructed and disposed to remain closed during substantially all of the upward and downward reciprocatory movements of the tubing and to become opened near the end of the downward movement of the tubing to provide for a passage of fluid from the storage chamber into the pump chamber for preventing fluid pounding in the upward reciprocatory movement of the tubing, at least one port being provided in the tubing at a position near the second valve to pass into the pump chamber the fluid flowing through the second valve from the well during the downward reciprocatory movement of the tubing, the tubing being hollow, and a fourth valve disposed above the second valve and having open and closed positions and operable in the open position during the upward reciprocatory movement of the tubing to provide for a passage of fluid from the pump chamber through the port and through the hollow tubing into the storage chamber and operable in the closed position during the downward movement of the tubing, and at least one port in the tubing at a position above the first valve to facilitate the passage of fluid from the pump chamber through the port into the storage chamber during the upward reciprocatory movement of the tubing, the second and fourth valves constituting ball check valves, the second member having an aperture to define the first valve with the first member.

18. A combination as set forth in claim 17 wherein the third means includes a port in the sleeve and wherein the port in the sleeve is co-operative with the tubing to define a valve having open and closed positions and wherein the disposition of the valve in the open position provides for a drainage of fluid from the pump chamber into the wells.

19. In combination for pumping viscous fluid from a well area defined by a casing extending downwardly into the well, a stationary sleeve disposed within the casing, a tubing disposed within the sleeve and reciprocatable upwardly and downwardly within the sleeve and defining a closure with the sleeve near the bottom of the tubing, first and second members disposed on the tubing at a position above the closure and capable of relative movements for defining a first valve having open and closed positions in accordance with the relative positions of the members and for defining a pump chamber with the closure and the sleeve and the tubing at positions below the first and second members and for defining a storage chamber at positions above the member, means co-operative with the second member for providing for the flow of fluid from the pump chamber to the storage chamber in the open position of the first valve, the first and second members being movable relative to each other to provide for a closure of the first valve during the downward reciprocatory movement of the tubing and to provide for an opening of the first valve during the upward reciprocatory movement of the tubing, means including a second valve having open and closed states and operative in the open state during the downward reciprocatory movement of the tubing to provide for a flow of fluid from the well into the pump chamber, means, including the tubing, defining a third valve having open and closed states, the third valve being operative in the closed state during substantially all of the downward and upward reciprocatory movements of the tubing but being operative in the open state near the end of the downward reciprocatory movement of the tubing to provide for a flow of fluid from the storage chamber to the pump chamber for inhibiting fluid pound in the tubing during the upward reciprocatory movement of the tubing, and means associated with the tubing and disposed at a position above the second valve for providing for a communication between the pump chamber and the storage chamber during the upward movement of the tubing and for blocking communication between the storage chamber and the well during the downward movement of the tubing.

20. The combination set forth in claim 19, including, means disposed in the tubing at a position near the second valve for providing for a passage into the pump chamber of the fluid flowing through the second valve from positions below the second valve during the downward reciprocatory movement of the tubing.

21. The combination set forth in claim 19, including, the tubing being hollow, and means disposed in the tubing at a position above the first valve for facilitating the flow of fluid from the pump chamber through the tubing into the storage chamber during the upward reciprocatory movement of the tubing.

22. The combination set forth in claim 19, including, the first valve including a port in the second member and the second valve constituting a ball check valve and the third valve including a port in the tubing.

23. The combination set forth in claim 22, including, the tubing being hollow, and means disposed in the tubing at a position above the first valve for facilitating the flow of fluid from the pump chamber through the tubing into the storage chamber during the upward reciprocatory movement of the tubing.

24. The combination set forth in claim 22, including, means disposed in the sleeve at a position below the closure, in the position of the tubing during the downward and upward reciprocatory movements of the tubing in the sleeve, for defining with the tubing a fourth valve having open and closed positions, the tubing being positionable relative to the sleeve to provide for an opening of the fourth valve and a flow of fluid from the space above the pump chamber through the pump chamber and the tubing and the third valve into the well when the tubing moves below the position defining the lower limit of the downward reciprocatory movement of the tubing.

25. In combination for pumping viscous fluid from a well area defined by a casing extending downwardly into the well, a stationary sleeve disposed within the casing, a tubing disposed within the sleeve and reciprocatable within the sleeve and defining a closure with the sleeve near the bottom of the tubing, first means including the sleeve and the tubing for defining a pump chamber above the well and for providing for the introduction of fluid from the well into the pump chamber during the downward reciprocatory movement of the sleeve, second means including the sleeve and the tubing for defining a storage chamber above the pump chamber and for providing for the introduction of fluid from the pump chamber into the storage chamber during the upward reciprocatory movement of the tubing, third means including the sleeve for providing for the introduction of fluid from the storage chamber into the pump chamber near the end of the downward reciprocatory movement of the tubing to inhibit fluid pounding during the upward reciprocatory movement of the tubing, and fourth means including the tubing for providing for the introduction of fluid from the pump chamber into the storage chamber during the upward movement of the tubing and for preventing the flow of fluid from the well into the storage chamber during the downward movement of the tubing.

26. In combination for pumping viscous fluid from a well area defined by a casing extending downwardly into the well, a stationary sleeve disposed within the casing, a tubing disposed within the sleeve and reciprocatable within the sleeve and defining a closure with the sleeve near the bottom of the tubing, first means including the sleeve and the tubing for defining a pump chamber above the well and for introducing fluid from the well into the pump chamber during the downward reciprocatory movement of the sleeve, second means including the sleeve and the tubing for defining a storage chamber above the pump chamber and for introducing fluid from the pump chamber into the storage chamber during the upward reciprocatory movement of the tubing, and third means including the sleeve for providng for the introduction of fluid from the storage chamber into the pump chamber near the end of the downward reciprocatory movement of the tubing to inhibit fluid pounding during the upward reciprocatory movement of the tubing, and means including the sleeve for draining fluid from the storage chamber and the pump chamber into the well upon a downward movement of the sleeve to a position below the lower limit of the downward reciprocatory movement of the tubing.

27. A combination as set forth in claim 26 wherein the tubing is hollow and wherein the tubing has a port disposed at a position providing communication between the storage chamber and the pump chamber when the port is open and wherein the port is disposed to be closed during substantially all of the downward and upward reciprocatory movement of the tubing and to be opened near the end of the downward reciprocatory movement of the tubing to provide for a flow of fluid from the storage chamber to the pump chamber for inhibiting fluid pounding during the upward reciprocatory movement of the tubing.

28. A combination as set forth in claim 27, including, a member slidable on the tubing for co-operating with the port in the tubing to define a valve with open and closed positions, the valve being closed during substantially all of the upward and downward reciprocatory movements of the tubing and being opened near the end of the downward reciprocatory movement of the tubing to provide for a flow of fluid from the storage chamber into the pump chamber and to inhibit fluid pounding during the upward reciprocatory movement of the tubing.

29. A combination as set forth in claim 27, including, a second member associated with the first member and having a port for co-operating with the first member to define a valve having open and closed positions for controlling communication between the storage chamber and the pump chamber, and means including the sleeve for draining fluid from the storage chamber and the pump chamber into the well upon a downward movement of the sleeve to a position below the lower limit of the downward reciprocatory movement of the tubing.

30. In combination for pumping viscous fluid from a well area defined by a casing extending downwardly into the well, a stationary sleeve disposed within the casing, a tubing disposed within the sleeve and reciprocatable within the sleeve and defining a closure within the sleeve near the bottom of the tubing, first means including the sleeve and the tubing for defining a pump chamber above the well and for introducing fluid from the well into the pump chamber during the downward reciprocatory movement of the sleeve, second means including the sleeve and the tubing for defining a storage chamber above the pump chamber and for introducing fluid from the pump chamber into the storage chamber during the upward reciprocatory movement of the tubing, and third means including the sleeve and the tubing for preventing a flow of fluid from the pump chamber into the well during the upward and downward reciprocatory movement of the well, and fourth means for providing for a flow of fluid from the pump chamber into the well upon a movement of the tubing below the lower limit of the downward reciprocatory movement of the tubing to obtain a cleaning of the pump chamber.

31. A combination as set forth in claim 30, including, the fourth means including the tubing and an aperture in the sleeve for providing for a flow of fluid from the storage chamber into the pump chamber upon a movement of the tubing below the lower limit of the downward reciprocatory movement of the tubing to obtain a cleaning of the storage chamber.

32. A combination as set forth in claim 31 wherein fifth means are operative to prevent a flow of fluid from the storage chamber to the pump chamber during substantially all of the downward and upward reciprocatory movements of the tubing but to provide for a flow of fluid from the storage chamber to the pump chamber near the end of the downward reciprocatory movement of the tubing to inhibit fluid pounding during the upward reciprocatory movement of the tubing.

33. A combination as set forth in claim 32 wherein the third means includes a port in the sleeve and wherein the port in the sleeve is co-operative with the tubing to define a valve having open and closed positions and a disposition of the valve in the open position provides for a drainage of fluid from the pump chamber into the well and the fifth means includes a port in the tubing and wherein a member slidable on the tubing is co-operative with the port in the tubing to define a second valve having open and closed positions and the disposition of the second valve in the open position provides for a drainage of fluid from the storage chamber into the pump chamber upon a disposition of the tubing below the lower limit of the downward reciprocatory movement of the tubing and provides for a flow of fluid from the storage chamber into the pump chamber near the end of the downward reciprocatory movement of the tubing.

34. A method of pumping viscous fluid from a well, including the steps of:

disposing in the well a sleeve and a hollow tubing reciprocatable upwardly and downwardly in the casing, pumping the viscous fluid from the well into a pump chamber disposed above the well and defined at least partially by the tubing and the sleeve during the time that the tubing is being reciprocated downwardly in the sleeve, pumping the viscous fluid from the pump chamber into a storage chamber disposed above the pump chamber and defined at least partially by the tubing and the sleeve during the time that the tubing is being reciprocated upwardly in the sleeve, preventing fluid from flowing from the well into the storage chamber during the downward movement of the tubing, preventing fluid from flowing from the pump chamber into the storage chamber during the downward movement of the tubing, preventing fluid from flowing from the storage chamber into the pump chamber during most of the downward movement of the tubing; and providing for a flow of fluid from the storage chamber into the pump chamber near the end of the downward reciprocatory movement of the sleeve to prevent fluid pound during the upward reciprocatory movement of the tubing.

35. A method of pumping viscous fluid from a well, including the steps of:

disposing in the well a sleeve and a tubing reciprocatable upwardly and downwardly in the casing, pumping the viscous fluid from the well into a pump chamber disposed above the well and defined at least partially by the tubing and the sleeve during the time that the tubing is being reciprocated downwardly in the sleeve, pumping the viscous fluid from the pump chamber into a storage chamber disposed above the pump chamber and defined at least partially by the tubing and the sleeve during the time that the tubing is being reciprocated upwardly in the sleeve, and providing for a flow of fluid from the storage chamber into the pump chamber near the end of the downward reciprocatory movement of the sleeve to prevent fluid pound during the upward reciprocatory movement of the tubing, and providing for a drainage of fluid from the storage chamber into the pump chamber and from the pump chamber into the well when the tubing is moved downwardly in the sleeve to a position below the lower limit of the downward reciprocatory movement of the tubing in the sleeve.

36. A method as set forth in claim 35 wherein the pump chamber is opened to the well, and the storage chamber is closed to the pump chamber, during the downward reciprocatory movement of the tubing in the sleeve, and wherein the pump chamber is closed to the well, and the storage chamber is opened to the pump chamber, during the upward reciprocatory movement of the tubing in the sleeve and wherein the storage chamber is opened to the pump chamber near the end of the downward reciprocatory movement of the tubing in the sleeve.

37. A method as set forth in claim 36 wherein the storage chamber is opened to the pump chamber, and the pump chamber is opened to the well, upon a movement of the tubing in the well below the lower limit of the downward reciprocatory movement of the tubing in the well to provide for a drainage of the fluid from the storage chamber and the pump chamber into the well.

38. In combination for pumping viscous fluid from a well area defined by a casing extending downwardly into the well, a stationary sleeve disposed with the casing, a tubing disposed within the sleeve and reciprocatable upwardly and downwardly within the sleeve and defining a first closure within the sleeve near its bottom end, a first member disposed on the tubing in slidable relationship to the tubing, a second member disposed on the tubing in co-operative relationship with the first member to define a first valve having open and closed positions, the first and second members being disposed above the first closure to define a pump chamber with the first closure, the tubing being spaced from the sleeve above the first valve to define a storage chamber with the first valve and the sleeve, and means defining a second valve with the sleeve at a position below the first valve and having open and closed positions and responsive to the downward movement of the tubing to become opened for providing for a flow of fluid into the pump chamber through the second valve from a position below the second valve, the first valve being closed during the downward movement of the tubing to provide for a flow of the viscous fluid into the pump chamber and a retention of such fluid in the pump chamber and being opened during the upward movement of the tubing to provide for a flow of the viscous fluid from the pump chamber into the storage chamber, at least one port is provided in the tubing at a position above the second valve to pass into the pump chamber the fluid flowing through the second valve, a third valve disposed above the second valve and having open and closed positions and operable in the open position during the upward movement of the tubing to provide for a passage of fluid from the pump chamber through the port into the storage chamber, at least one port in the tubing at a position above the first valve and responsive to the slidable position of the first member on the tubing to facilitate the passage of fluid from the pump chamber through the port into the storage chamber during the upward movement of the tubing, at least one port in the tubing and co-operative with the first member for defining with the first member a fourth valve having open and closed positions and operative in the open position near the end of the downward movement of the tubing to provide for the passage of fluid from the storage chamber into the pump chamber near the end of such downward movement of the tubing, thereby preventing fluid pound in the upward movement of the tubing, and a port in the sleeve at a position below the second valve and defining a fifth valve with the tubing, the portion of the tubing defining the closure with the sleeve being positionable to provide for an opening of the fifth valve during the opening of the fourth valve for a drainage of fluid from the storage chamber through the fourth and fifth valves into the tubing at a position below the second valve.

* * * * *